US005485693A

United States Patent [19]

Frenken et al.

[11] Patent Number: 5,485,693

[45] Date of Patent: Jan. 23, 1996

[54] HINGED SUPPORT PANEL DISPLAY PRISM

[75] Inventors: Egbert Frenken; Michael Schöning, both of Heinsberg, Germany

[73] Assignee: M & V Reklametechnik Schoning-Krieg, Heinsberg, Germany

[21] Appl. No.: 215,901

[22] Filed: Mar. 22, 1994

[30] Foreign Application Priority Data

Jul. 12, 1993 [DE] Germany ..... 43 23 200.0

[51] Int. Cl.[6] ..... G09F 11/02

[52] U.S. Cl. ..... 40/505; 40/503; 16/365; 16/386

[58] Field of Search ..... 362/282, 812; 40/502, 503, 504, 505, 506; 16/365, 386, 346

[56] References Cited

U.S. PATENT DOCUMENTS

| | | | |
|---|---|---|---|
| 784,361 | 3/1905 | Stuhler | 40/503 X |
| 790,739 | 5/1905 | McNeal | 40/502 X |
| 1,916,209 | 7/1933 | Furlong | 16/365 X |
| 3,313,131 | 4/1967 | Werner | 40/505 |
| 4,024,605 | 5/1977 | Henke | 16/386 X |
| 5,315,776 | 5/1994 | Strawbridge et al. | 40/505 |

FOREIGN PATENT DOCUMENTS

| | | | |
|---|---|---|---|
| 379311 | 7/1990 | European Pat. Off. | 40/503 |

*Primary Examiner*—Joanne Silbermann
*Attorney, Agent, or Firm*—Shefte, Pinckney & Sawyer

[57] ABSTRACT

A display device of the type having a plurality of parallel prisms that rotate intermittently and synchronously to present the surfaces of the different panels of each prism for view to provide different composite advertising designs. All the prisms are identical and each is formed with three identical panels that are rectangular and extend longitudinally of the prism. The panels have hinge sections formed integrally along their edges for meshing with hinge sections of adjacent panels in a piano-hinge-like arrangement. A removable hinge pin is disposed in at least one hinge connection so that upon removal of the hinge pin the adjacent panel can be swung open to allow access to the interior of the prism for changing a burned out illuminating device, such as a fluorescent or neon light.

20 Claims, 3 Drawing Sheets

HINGED SUPPORT PANEL DISPLAY PRISM

BACKGROUND OF THE INVENTION

The invention relates to an advertising device for advertising designs that change by having a plurality of rotatable prisms which are each preferably triangular, with the surfaces of the prisms being exposed sequentially for view with corresponding surfaces of other prisms in the device to present different advertising displays upon rotation of the prisms and with each prism being illuminated from inside as by a stationary lamp.

Prism advertising devices of this general type are known in the industry. The prism may be disposed horizontally or vertically for display. In large advertising panels taller than approximately 2 meters the prisms are normally disposed vertically, preferably suspended from the upper end, for the sake of mechanical stability. The rectangular panels of each triangular prism are joined together by an equilateral triangular base at each end to stabilize the arrangement. The drive for pivoting the prism generally engages one of these triangular bases, one of which usually has an opening through which the mount and the power supply of an illumination device, such as a fluorescent or neon lamp, extends for mounting the illuminating device within the prism. The lamp remains stationary when the prism is pivoted. The pivoting is intermittent with all of the prisms pivoting simultaneously to present advertising surfaces across the device for viewing in a composite design.

The lamps used in the advertising devices described have a limited, and usually highly variable, service life. Accordingly, lamps fail without predictability. In prior devices, a failed lamp has to be pulled out through one end of the prism, and the new lamp is introduced into the prism in the same way.

The advertising device of the type described can be produced in considerable size, for instance with a height of from 1 meter to 6 meters and a width of from 2 meters to 20 meters. As noted, in relatively large advertising panels the prisms are preferably disposed vertically next to one another. If an advertising device of this kind is designed for operation in the open air, then the prisms and particularly the region above each prism must be carefully protected against the effects of weather in order to protect the mechanical and electrical parts. If a lamp in one prism fails, then the entire prism has to be dismantled so that the lamp can be pulled out of the prism. If the cover on the top of the prism of an advertising wall has to be removed, ladders are needed in order to pull the lamp out at the top or insert a lamp into the prism from the top. Hence the effort and expense for changing a lamp is considerable—and the situation is quite similar even when the prism is horizontally supported.

SUMMARY OF THE INVENTION

An object of the present invention is to replace illumination devices in such prisms without the requirement that special prism panels for the prism be used, and, which preferably allows the use of entirely identical rectangular panels for all sides of the prism, and allows at least one of the prism panels to open like a door for access to the interior of the prism to replace burned out lamps without dismantling the entire prism.

This and other objects of the present invention are accomplished with a display device for displaying designs having at least one prism, which has at least three rectangular side panels having display surfaces thereon and extending parallel to the axis of the at least one prism. Each panel has two longitudinal edges and two ends with adjacent panels connected to each other along the longitudinal edges. Bases are attached to the ends of at least two of the panels to form the bases of the at least one prism, with the two panels being rigidly secured together along their adjacent longitudinal edges. A hinge joins one of the two panels to an adjacent third panel along adjacent longitudinal edges thereof. Means releasably secure the third panel to an adjacent panel along the longitudinal edge of the third panel opposite the hinged edge to allow opening of the third panel for access to the interior of the at least one prism. A device rotates the at least one prism about its axis to present the panels individually for view. An illuminating device including at least one replaceable illuminating element disposed within the at least one prism illuminates the panels and is replaceable when the third panel is open.

The releasably securing means may include a hinge extending substantially continuously along the length of the panel edges. The hinge is secured directly to the respective longitudinal edges of the adjacent panels after the panels have been fabricated. The hinges are preferably formed as continuous tubes and can be secured to the longitudinal edge of one panel, and then at least one section of each tube is cut out and secured to the adjacent panel in such a manner that the sections mesh with one another to hingedly secure the panels together upon insertion of a hinge pin through the tube sections.

The prism may comprise an equilateral triangle in cross section and the illuminating device mounted in the interior may be disposed relative to the intersection of a median line of the equilateral triangle cross section of the prism away from the side of an observer of an advertisement on the advertising device, preferably approximately to the center of the median line aligned with the observer.

The hinge between the second and third panels may have a hinge pin that is removable to allow separation of the hinge and the opening of the third panel. This hinge pin is substantially continuous along the longitudinal edge of the panel and is preferably flexible for bending away from the axis of the hinge during removal and insertion of the hinge pin.

The two rigidly secured panels may be secured by an immobilized hinge which may be substantially continuous substantially along the length of the longitudinal edge.

Preferably, the panels and hinges are translucent. The at least three panels including each hinge mounted thereon may be identical and interchangeable upon assembly, resulting in simplified manufacturing and reduced inventory requirements.

DETAILED DESCRIPTION OF THE INVENTION

Figure 1:
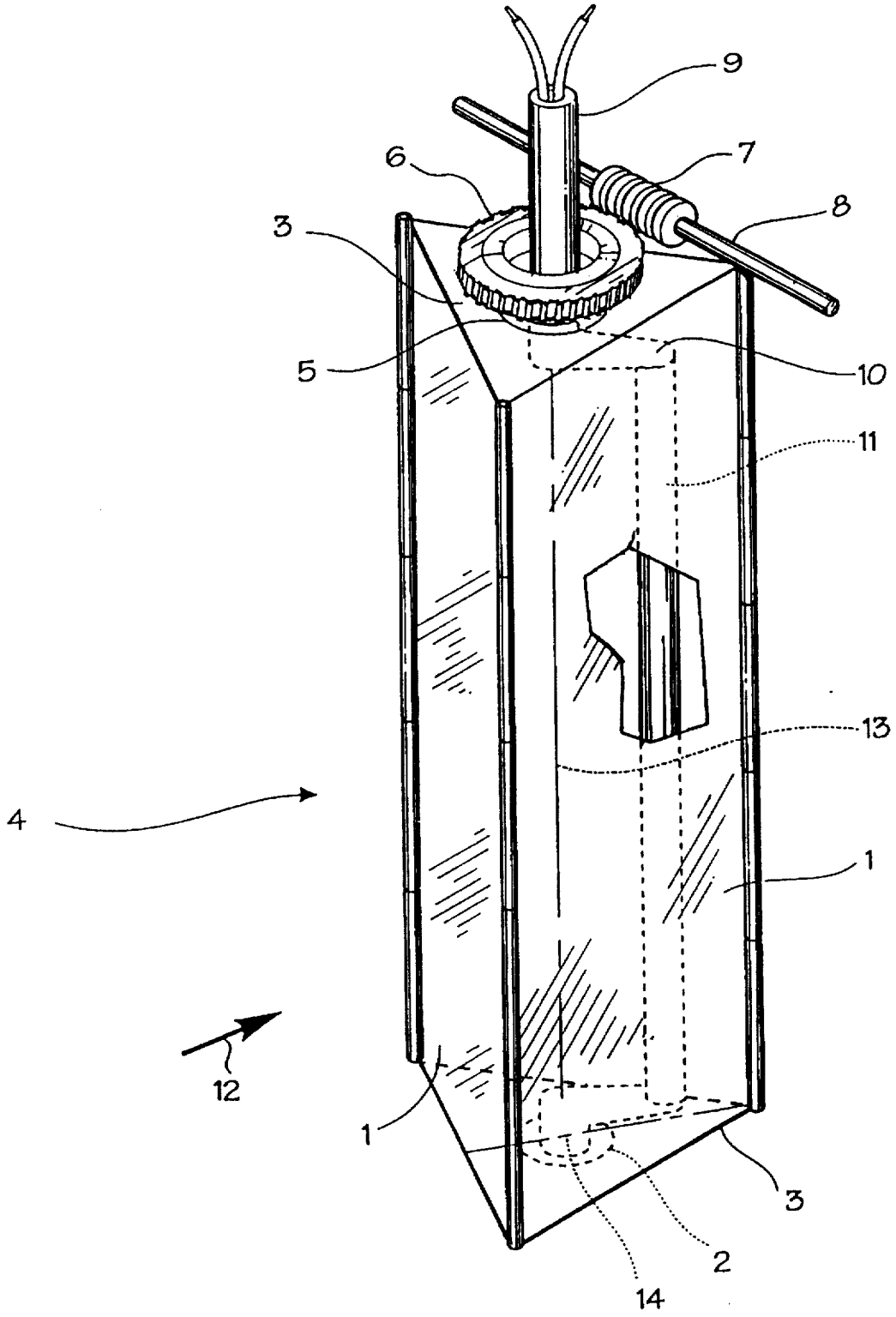
FIG. 1 is a perspective view of a vertically arranged prism.

The prism of FIG. 1 is a rotatable triangular prism 4 of an advertising device having three rectangular panels 1, two triangular end pieces or bases 3 connected to the ends of the panels with openings 2. A gear wheel 6 is mounted on one of the bases 3 with the aid of a ring flange 5. Meshing with the gear wheel 6 is a worm 7 with a drive shaft 8, the worm being positioned in the advertising device in a manner that is hidden in FIG. 2. The axis of the gear wheel 6 coincides with the axis of the prism 4. A mount 9 with an integrated power lead extends through the open middle of the gear wheel 6 and the opening 2 in the base 3. An illuminating device, such as a fluorescent tube 11, is mounted on the mount 9 inside the prism 4, in combination with a mechanical deflector 10. Depending on the embodiment and size of the prism 4, a series of fluorescent tubes-may be arranged longitudinally or parallel in the prism 4. The mount 9 and the fluorescent tube 11 remain stationary during rotation of the prism 4.

It may be preferred that the fluorescent tube 11 is located some distance behind the prism axis 13 to result in better display of the advertisement depending upon where an observer is viewing the advertisement. Preferably, the fluorescent tube 11 may be positioned approximately in the middle of the median line 14 of the equilateral triangle cross section of the prism 4 with the median line aligned with the observer. Thus, the prism face toward the observer can be more evenly lighted than if the light source were disposed on the prism axis.

Figure 2:
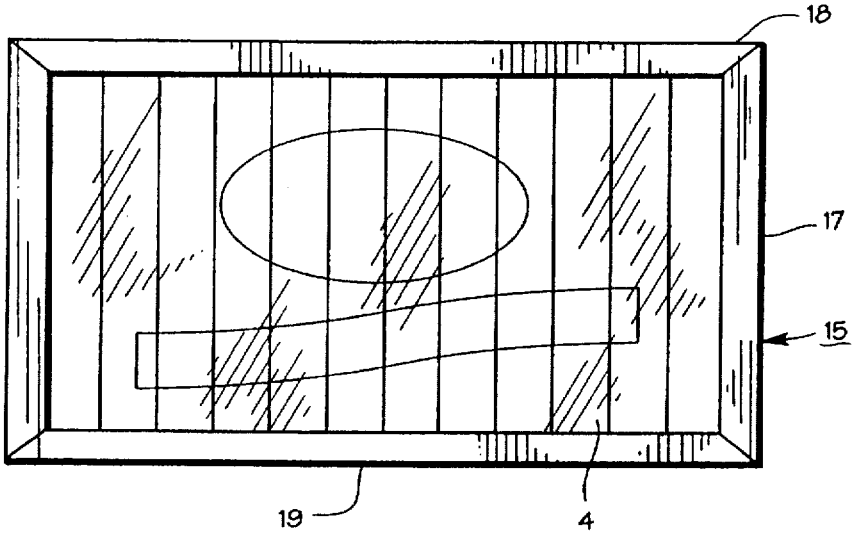
FIG. 2 is an elevational view of an advertising device with a plurality of prisms disposed side by side.

FIG. 2 shows an advertising device 15 with a number of prisms 4 of FIG. 1 arranged vertically side-by-side. Around the advertising face 16 formed of the rectangular panels 1 of the prisms 4, the advertising device has a frame having sides 17, a top 18 and a bottom 19. This frame serves not only an aesthetic purpose but also to protect against the penetration of dust and similar dirt, and also, in an outdoor display, to protect against the effects of weather.

Figure 3:
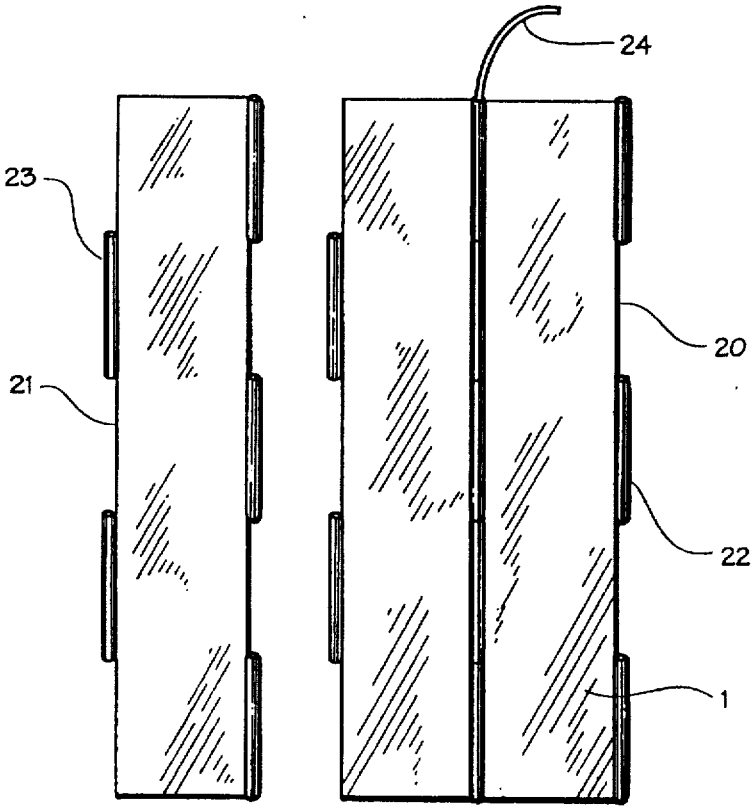
FIG. 3 is an elevational view of three identical, single prism panels aligned in a common plane prior to assembly to produce a prism of FIG. 1.
Figure 5:
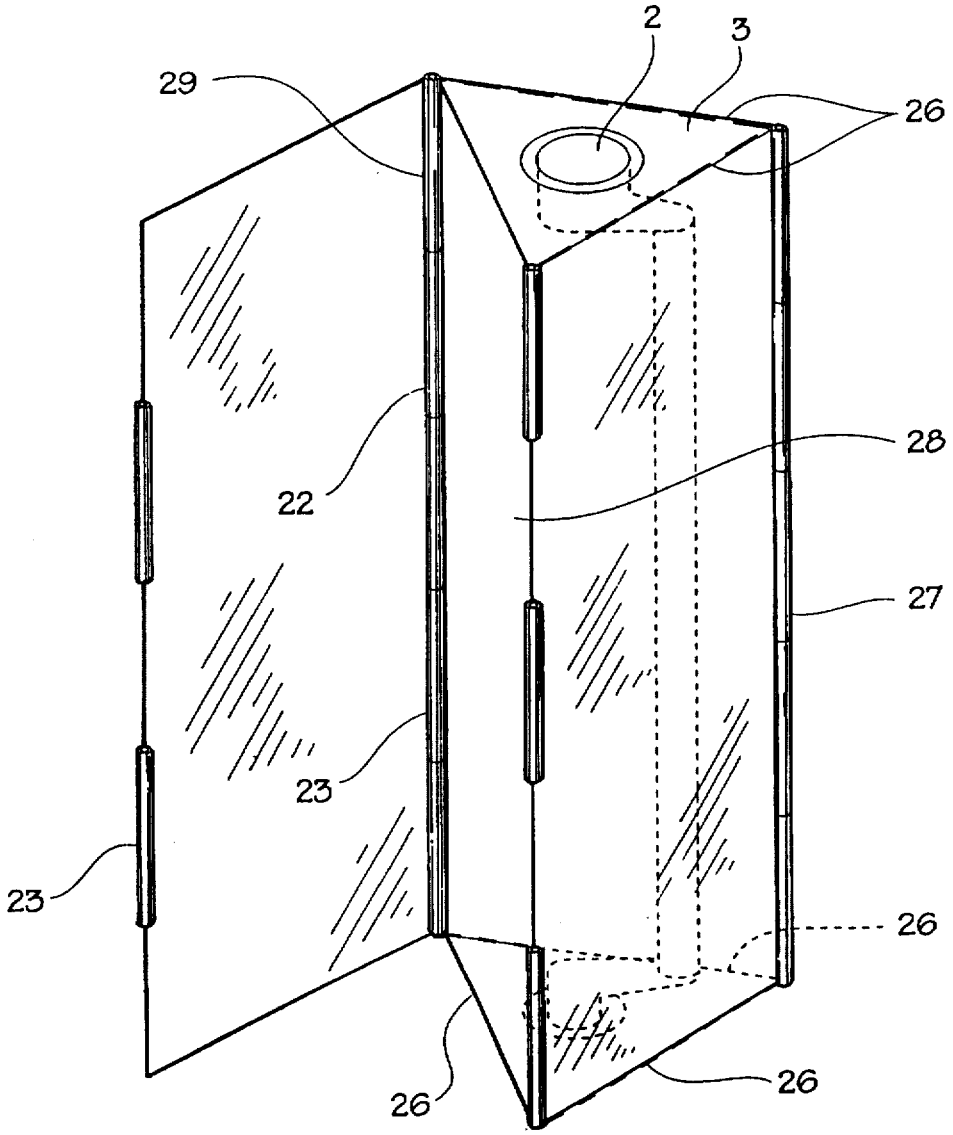
FIG. 5 is a perspective view of a prism with a panel opened.
Figure 4:
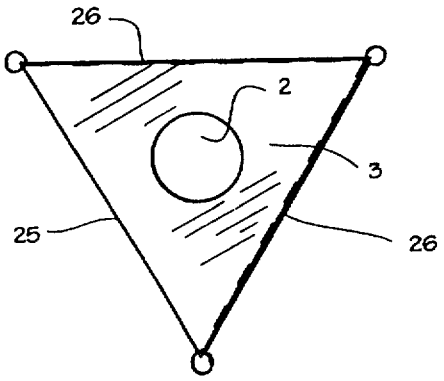
FIG. 4 is an end view of the prism of FIG. 1.

According to the preferred embodiment of the invention, each prism 4 of FIG. 1 or 2 comprises three identical rectangular panels 1 as shown in FIG. 3 and two identical triangular bases 3 as shown in FIG. 4, each secured, as by adhesive, to the ends of two of the panels 1*a* and 1*b*. In the illustrated embodiment, each rectangular panel 1 has a tubular hinge formed in sections 22,23 substantially along the length of the longitudinal edges 20,21 thereof. The distribution of the hinge sections 22,23 along the longitudinal edges 20,21 is selected such that the hinge sections 22,23 of adjacent panels mesh with one another. A flexible, preferably translucent, rod 24, acting as a hinge pin, is inserted into the hinge sections 22,23 in such a way that the rectangular panels 1 are secured together as if by a piano hinge. As assembly continues, one triangular end piece 3 is inserted into each long end of the prism 4 made up by three rectangular panels 1 to be joined together, and these triangular panels are joined firmly, for instance either directly via the materials involved or by screwing, to the aforementioned two adjacent rectangular panels 1*a*,1*b*. It is understood that the same two panels 1 are joined along the long edges of the prism 4 with the triangular base 3, while the third panel 1*c* is intended to rest loosely against the adjoining edge 25 of the triangular base as shown in FIG. 5. FIG. 5 illustrates the bonding 26 between the two rectangular panels 1*a*,1*b* and the triangular base 3. The third rectangular panel 1*c* shown in FIG. 5 is openable in the manner of a door. In the secured state, it contacts the triangular base 3 along the adjacent side 25 of the base.

The prism 4 according to the invention, like any prism conventionally used in the advertising device, has three superficially identically embodied long edges, but the three edges have different mechanical functions. The prism edge 27 between the rectangular panels 1*a*,1*b* has its hinge sections 22,23 adhesively bonded together to form an immobilized rigid hinge. The sections 22,23 joined together by the hinge pin 24 serve merely to keep the edges of the prism firmly secured together. The prism edge 28 and its hinge sections 22,23 and hinge pin 24 form a releasable lock. Preferably it is only at this point that the elastic pin 24 is utilized, in such a way that it can be pulled out of the hinge sections 22,23 longitudinally of the hinge. Only at the prism edge 29 does the piano-hinge-like hinge running substantially the length of the edge have its actual function, namely making the rectangular panel 1 contacting side 25 of the triangular base 3 operate as a door to the interior of prism 4.

For the observer, all three long edges of the prism look identical; when the panels intermesh with one another accurately (i.e. substantially without spacing between one another), they look and function like smooth edges. If the hinge sections and hinge pin are made of substantially the same material as the other parts of the prism, they have a shadow-free effect and are just as corrosion-free as the prism itself.

The flexibility of the hinge pin is important in the context of the present invention so that it can be pulled out past the hinge sections and threaded into the hinge sections again while deflecting or bending around the top or bottom of the frame above or below (or laterally of) the installed prism. Optionally, the assembler can accordingly pull the hinge pin—virtually like a stiff cord—out of its seat in its hinge sections on one side of the prism panel that acts as a door, bending it around so as to circumvent the peripheral parts of the advertising surface such as the frame. This means, for instance, that even with vertical positioning of the prisms tall ladders are therefore not needed, the assembler merely having to be able to reach as far as the upper or lower end of the piano-hinge-like hinge and pull the hinge pin out of its seat or thrust it into the seat.

Further according to the invention, the rectangular panels can be fabricated in either of two ways. First, the hinges can be mounted directly, by adhesive, to the edges of the rectangular panels after the panels have been produced. The hinge sections should then be put in place at a predetermined spacing, for instance being welded on or adhesively bonded on, in such a way that when the prism is put together the sections intermesh with one another as accurately as possible. Second, and preferably, when the rectangular panels are produced the hinge sections can initially be formed as continuous, one-piece tubes along the edges of a panel. Upon extrusion, the rectangular panels can thus be made with continuous hinge tubes along their edges, in a relatively uncomplicated way. Once these panels, extruded in the form of a practically endless strip, have been finished, parts of each tube formed on the edge of the panel are then removed to form meshing hinge sections in adjacent panels in the manner of the sections of a piano hinge.

In summary, the invention is based on the need to avoid the effort and expense of replacing an illuminating device in one of the prisms of an advertising device. The effort and expense are reduced according to the invention if one of the rectangular panels 1 that makes up the prism 4 can be removed from the prism or folded open like a door relative to the interior of the prism. At first, it would appear that the panels forming the prism would have to be embodied differently from one another, resulting in more expensive fabrication, inventory and spare parts procurement. However, the invention described above avoids these problems with an assembly calling for identical rectangular panels with integral hinge sections.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A display device for displaying designs comprising:

(a) at least one assembled prism having at least three rectangular side panels having display surfaces thereon and extending parallel to the axis of said assembled prism, each said panel having two longitudinal edges and two ends with adjacent panels connected to each other along their respective adjacent longitudinal edges;

(b) end pieces each attached to a said end of at least one of two said panels to form with all said panels said assembled prism;

(c) a hinge joining a first panel to an adjacent third panel along adjacent longitudinal edges thereof;

(d) means releasably securing said third panel to an adjacent second panel along the longitudinal edge of said third panel opposite said hinge to allow opening of said third panel relative to said end pieces for accessing the interior of said assembled prism, wherein said end pieces remain attached to said at least one other than said third panel;

(e) means for rotating said assembled prism about its axis to present said panels individually for view; and (f) illuminating means including at least one replaceable illuminating element disposed within said assembled prism to illuminate said panels and being replaceable when said third panel is open.

2. A display device according to claim 1 wherein said releasably securing means comprises a substantially continuous hinge extending substantially the length of said panels and including a removable hinge pin.

3. A display device according to claim 2 wherein said hinge pin is flexible and capable of bending away from the axis of the hinge during removal and insertion of said hinge pin.

4. A display device according to claim 2 wherein said first and said second panels are secured together by an immobilized hinge.

5. A display device according to claim 4 wherein said immobilized hinge is substantially continuous the length of said longitudinal edges of said panels.

6. A display device according to claim 5 wherein each of said hinges has sections secured to longitudinal edges of adjacent panels.

7. A display device according to claim 6 wherein said at least three panels with their respective hinge sections secured thereto are identical and interchangeable.

8. A display device according to claim 5 wherein said panels and said hinges are translucent.

9. A display device according to claim 1 wherein said panels are translucent.

10. A display device according to claim 1 wherein each said prism comprises an equilateral triangle in its cross section and wherein said illuminating element is mounted at a spacing from the axis of the prism along a median line of said equilateral triangle cross section prism away from the side of an observer of an advertisement on the advertising device.

11. A display device for displaying advertisements, comprising:

(a) at least one assembled prism, each said assembled prism having at least three rectangular display panels that extend parallel to the axis of said assembled prism, each said panel having two longitudinal edges and two ends with adjacent panels connected to each other along their respective adjacent longitudinal edges, (b) end pieces each attached to a said end of at least one of said panels to form the bases of said assembled prism, said end pieces and said at least one attached panel forming a support structure of said assembled prism, all of said panels and said end pieces defining an interior space within said assembled prism, and (c) a plurality of hinges, each said hinge connecting two longitudinal edges of two said adjacent panels together, at least one hinge of said plurality of hinges having a removable hinge pin, and at least one other hinge of said plurality of hinges being operational for door-like movement of at least one connected panel about said operational hinge, (d) wherein said at least one connected panel is openable in door-like fashion when said hinge pin is removed from said at least one hinge for accessing the interior space of said prism without disassembling said support structure of said assembled prism.

12. A display device according to claim 11, wherein at least one said hinge pin is flexible and capable of bending away from the axis of a said hinge during removal and insertion of said hinge pin, thereby permitting easy removal and insertion of said hinge pin within said hinge.

13. A display device according to claim 12 further comprising illuminating means disposed within the interior space of said assembled prism to illuminate said panels and including at least one replaceable illuminating element, said panels being translucent and said illuminating element being replaceable when said at least one connected panel is opened, and means for rotating said assembled prism about its axis to represent said panels for individual viewing, said means located outside of the interior space of said assembled prism.

14. A display device according to claim 13, wherein all said panels are individually identical and interchangeable and all said hinges are individually identical and interchangeable.

15. A display device according to claim 13, wherein all said panels and all said hinges are translucent.

16. A display device according to claim 13 wherein each said assembled prism comprises an equilateral triangle in its cross section and wherein said illuminating element is mounted at a spacing from the axis of said assembled prism along a median line of said equilateral triangle cross section away from the side of an observer of an advertisement on the advertising device.

17. A display device according to claim 11 further comprising illuminating means disposed within the interior space of said assembled prism to illuminate said panels and including at least one replaceable illuminating element, said illuminating element being replaceable when said at least one connected panel is opened, and wherein at least one of said panels is translucent.

18. A display device according to claim 17 wherein said assembled prism comprises an equilateral triangle in its cross section and wherein said illuminating element is mounted at a spacing from the axis of said assembled prism along a median line of said equilateral triangle cross section away from the side of an observer of an advertisement on the advertising device.

19. A display device according to claim 11, and further comprising:

illuminating means disposed within the interior space of said assembled prism to illuminate all said panels and including at least one replaceable illuminating element, said replaceable illuminating element being replaceable when said connected panel is opened, and means for rotating said assembled prism about its axis to represent said panels for individual viewing, said means located outside of the interior space of said assembled prism, wherein at least one said hinge pin is flexible and capable of bending away from the axis of a said hinge during removal and insertion of said hinge pin, thereby permitting easy removal and insertion of said hinge pin within said hinge, and wherein each said prism comprises an equilateral triangle in its cross section and wherein said illuminating element is mounted at a spacing from the axis of said assembled prism along a median line of said equilateral triangle cross section away from the side of an observer of an advertisement on the advertising device, and wherein all said panels are individually identical and interchangeable, all said hinges are individually identical and interchangeable, and all said panels and all said hinges are translucent, thereby providing for shadow-free illumination of advertising on said panels.

20. A display device for displaying advertisements, comprising:

at least one prism having at least three rectangular side panels having display surfaces thereon and extending parallel to the axis of said prism, said panels having two longitudinal edges and two ends with adjacent panels connected to each along said longitudinal edges;

end pieces attached to said ends of at least two of said panels to form the bases of said prism;

said two panels being secured together along their adjacent longitudinal edges;

a hinge joining one of said two panels to an adjacent third panel along adjacent longitudinal edges thereof;

means releasably securing said third panel to an adjacent panel along the longitudinal edge of said third panel opposite said hinge for accessing the interior of said prism; and illuminating means including at least one replaceable illuminating element disposed within said prism to illuminate said panels and being replaceable when said prism is opened;

wherein said prism comprises an equilateral triangle in its cross section and wherein said illuminating element is mounted at a spacing from the axis of the prism along a median line of said equilibrium triangle cross section away from the side of an observer of an advertisement on the advertising device.

* * * * *